United States Patent [19]

Fenton et al.

[11] 4,111,176

[45] Sep. 5, 1978

[54] ENGINE SHUTDOWN CONTROL

[75] Inventors: Alvin P. Fenton, Oostburg; Roger T. Gault, Sheboygan Falls; Lawrence J. Bernauer, Kohler, all of Wis.

[73] Assignee: Kohler Co., Kohler, Wis.

[21] Appl. No.: 795,784

[22] Filed: May 11, 1977

[51] Int. Cl.[2] ..... F02B 77/08

[52] U.S. Cl. ..... 123/198 DB; 123/DIG. 11; 123/97 B; 123/136

[58] Field of Search ..... 123/DIG. 11, 198 D, 123/198 DB, 97 B, 136

[56] References Cited

U.S. PATENT DOCUMENTS

| | | | |
|---|---|---|---|
| 3,374,777 | 3/1968 | Walker | 123/DIG. 11 |
| 3,517,653 | 6/1970 | Hajime Ariga et al. | 123/DIG. 11 |
| 3,618,581 | 11/1971 | Simonet | 123/DIG. 11 X |
| 3,802,403 | 4/1974 | Dewick et al. | 123/DIG. 11 X |

FOREIGN PATENT DOCUMENTS

| | | | |
|---|---|---|---|
| 1,434,002 | 4/1976 | United Kingdom | 123/DIG. 11 |

*Primary Examiner*—Charles J. Myhre
*Assistant Examiner*—Ira S. Lazarus
*Attorney, Agent, or Firm*—Thad F. Kryshak

[57] ABSTRACT

A carburetor having a venturi constriction within an air passage leading to the engine intake manifold, a fuel bowl with a discharge nozzle for delivering fuel to the venturi constriction, and a bowl vent passage between the fuel bowl and a position at atmospheric pressure, includes a duct communicating between the venturi constriction and the fuel bowl. A solenoid valve is disposed in the bowl vent passage and is operatively connected to the ignition; the valve is open when the ignition is turned on so that the fuel bowl is exposed to atmospheric pressure allowing the nozzle to discharge fuel into the venturi constriction, and it is closed when the ignition is turned off. With the valve closed, the pressures in the venturi constriction and the fuel bowl are equalized preventing the flow of fuel through the nozzle to the venturi constriction and inhibiting "dieseling" after ignition shut-off.

4 Claims, 4 Drawing Figures

ENGINE SHUTDOWN CONTROL

BACKGROUND OF THE INVENTION

This invention relates to an "anti-dieseling" device for a carburetor, and more particularly to an arrangement which prevents the delivery of fuel to the engine intake manifold when the ignition is turned off.

The problem of "dieseling" or "run-on" is commonly encountered in the use of internal combustion engines—when the ignition is turned off, the engine does not immediately cease operating. In order to prevent this occurence, the prior art has provided a number of assemblies, all having certain disadvantages. In some of these arrangements, a valve is positioned within a passage to preclude the supply of fuel to the engine after the ignition has been turned off. See, for example, U.S. Pat. No. 3,802,403 issued to Dewick, et al. on Apr. 9, 1974 for "Run-On Prevention Means For Spark-Ignition Internal Combustion Engines Including Evaporative Loss Canisters." Another approach has been to employ a device which causes the throttle to close upon ignition shut-off. None of these arrangements has been entirely satisfactory, however, and the present system has been developed to provide an improved dieseling control.

SUMMARY OF THE INVENTION

The present invention contemplates an engine shutdown control which prevents dieseling of the engine after the ignition is turned off. More specifically, the invention resides in equalizing the pressures at the fuel discharge nozzle and in the fuel bowl of a conventional carburetor to retard the delivery of fuel to the air passage. This is accomplished by interposing a duct between the air passage and the fuel bowl substantially coplanar with the fuel discharge nozzle, and positioning a valve which is operatively connected to the ignition within a vent leading from the fuel bowl to a position at atmospheric pressure. The valve will remain open while the ignition is turned on; the fuel bowl will be exposed to atmospheric pressure, and the discharge nozzle will be exposed to a lower pressure; as a result, fuel will be fed to the air passage. The valve closes upon ignition shut-off; this blocks the vent to atmospheric pressure, and, since the air passage and the fuel bowl communicate with one another through the duct, the pressures within the passage and the bowl will be equalized. Because there is now a lack of pressure differential, fuel will not flow through the nozzle into the air passage; without a delivery of fuel to the intake manifold, dieseling will not occur.

In a preferred form, the duct communicates at one end with the air passage and at its other end with the bowl vent; however, the duct could communicate directly at the latter end with the fuel bowl. An important feature of the invention is to provide a connection between the air passage and the fuel bowl to equalize the pressures at the fuel discharge nozzle and in the fuel bowl upon ignition shut-off; either connection will achieve this result. The diameter of the duct should be relatively small compared to the diameter of the bowl vent passage; otherwise, although the valve in the vent is open, the pressures in the air passage and in the fuel bowl will tend towards equalization. This could reduce the fuel flow from the bowl to the air passage, thus hampering efficient operation of the carburetor during normal conditions. The preferred valve in the bowl vent is a solenoid valve, and it is connected to the ignition; it effectively opens when the ignition is turned on and closes when the ignition is turned off.

It is an object of the invention to provide an improved engine shutdown control which prohibits fuel admission to the intake manifold upon ignition shut-off, thus preventing dieseling.

It is another object of the invention to provide an improved engine shutdown control which is highly effective, but is also relatively inexpensive and easy to manufacture, assemble, maintain and use.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, but rather the invention may be employed in many different embodiments, and reference is made to the claims herein for interpreting the breadth of the invention.

DESCRIPTION OF THE PREFERRED EMBODIMENT

Figure 1:
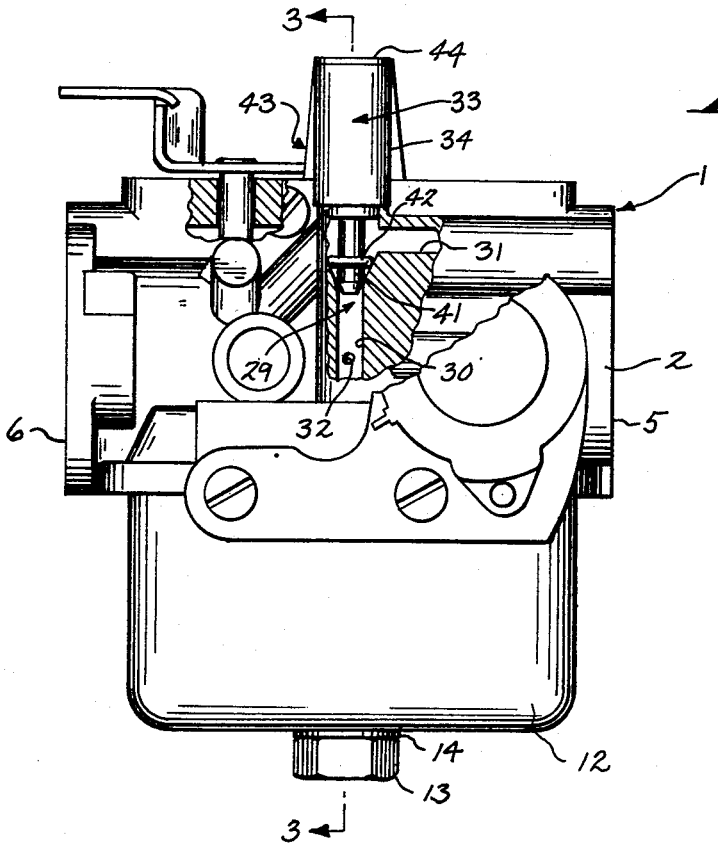
FIG. 1 is a side view with parts cut away of a carburetor constituting a preferred embodiment of the invention.
Figure 2:
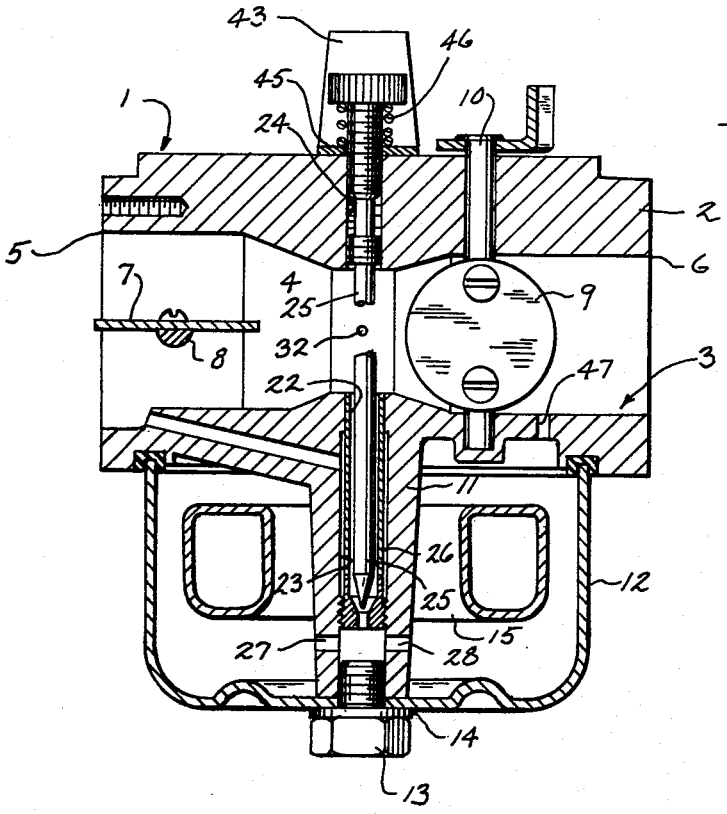
FIG. 2 is a view in cross-section taken along the plane of the line 2—2 shown in FIG. 3.
Figure 3:
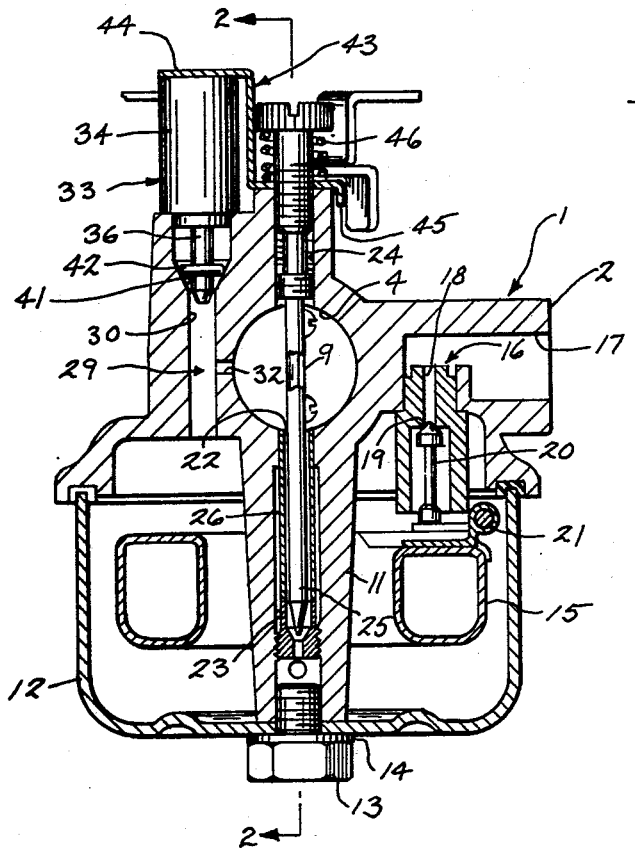
FIG. 3 is a view in cross-section taken along the plane of the line 3—3 shown in FIG. 1.

Referring to FIGS. 1–3, there is shown a carburetor, designated generally by the numeral 1, having a housing 2 which mounts the conventional carburetor components. Within the housing 2, there is a generally, cylindrically shaped air induction passage 3 having a venturi constriction 4. One end 5 of the passage 3 communicates with an air cleaner (not shown), while the opposite end 6 of the passage 3 leads to an engine intake manifold (not shown). A choke plate 7 is located within the passage 3 upstream from the venturi constriction 4, and it is rotatable by means of a choke linkage 8. A throttle plate 9 is positioned within the passage 3 downstream from the venturi constriction 4, and it is rotatable by means of a manual throttle mechanism 10. The underside of the carburetor housing 2 has an integral depending portion 11 which tapers downwardly; a fuel bowl 12 is connected by a through bolt 13 and a gasket 14 to the bottom of the depending portion 11. Within the fuel bowl 12, there is an annular float assembly 15 concentric with the depending portion and which maintains a desired fuel level in the bowl 12.

As shown in FIG. 3, fuel is delivered to the fuel bowl 12 through a fuel inlet system, indicated generally by the numeral 16. The system 16 includes a fuel inlet port 17 which is joined to a fuel tank (not shown) in a conventional fashion. The fuel inlet port 17 communicates with a fuel passage 18 formed in an inlet needle seat 19 mounted within the carburetor housing 2. The fuel passage 18 extends through the inlet needle seat 19 to the fuel bowl 12; an inlet needle 20 is disposed in the inlet needle seat 19, and it controls the amount of fuel admitted to the bowl 12. The lower end of the inlet needle 20 is headed and rests upon a bracket 21 which is pivotally mounted atop the float assembly 15. When the fuel level drops below the desired depth, the float assembly 15 lowers the inlet needle 20 allowing fuel flow into the bowl 12; after the desired level is restored, the float assembly 15 raises the inlet needle 20 to close the fuel passage 18.

During operation, air flows through the air passage 3 from the air cleaner to the engine intake manifold; both the choke plate 7 and the throttle plate 9 are open, i.e., in the positions shown in FIG. 2. With reference to FIG. 2, as the air flows through the air induction passage 3, a pressure drop is developed in the venturi constriction 4, and fuel is drawn from the fuel bowl 12 through a nozzle 22 into the venturi constriction 4. The nozzle 22 is at the upper end of a vertical bore 23 passing through the depending portion 11 of the carburetor housing 2. An axial bore 24 also extends through the carburetor housing 2 above the venturi constriction 4 to the top of the carburetor housing 2; the axial bore 24 is disposed along the same upright axis as the vertical bore 23. A fuel adjustment needle 25 is positioned within the vertical bore 23 and the axial bore 24, and it is surrounded within the vertical bore 23 by a sleeve 26. Within the housing 2, there are a pair of ports 27 and 28, which communicate with the fuel bowl 12 and the vertical bore 23. The ports 27 and 28 extend radially from the vertical bore 23, and they are longitudinally located beneath the lower end of the sleeve 26. When the nozzle 22 is at a lower pressure than the fuel in the bowl 12, fuel will be drawn through the ports 27 and 28 into the vertical bore 23 between the needle 25 and the sleeve 26 and discharged through the nozzle 22 into the venturi constriction 4. The fuel in the bowl 12 is normally at atmospheric pressure; the fuel bowl 12 communicates with the air cleaner through a bowl vent passage 29. As shown best in FIG. 1, the bowl vent passage 29 includes a vertical channel 30 and a horizontal channel 31; the vertical channel 30 extends upwardly from the bowl 12 through the carburetor housing 2 into the horizontal channel 31 which extends through the carburetor housing 2 alongside the air induction passage 3 to the air cleaner.

The carburetor as described to this point can be considered conventional and known and understood by those skilled in the art.

As a distinct feature, there is a duct 32 interposed between the bowl vent passage 29 and the venturi constriction 4 of the air induction passage 3. The duct 32 extends radially outwardly generally perpendicular to the direction of air flow through the air passage 3, and it leads to the vertical channel 30 of the bowl vent passage 29. At the intersection of the vertical channel 30 with the horizontal channel 31, there is a solenoid valve 33 which is operative between a pair of positions, one position opening and the other closing the vertical channel 30. The solenoid valve 33 includes a cylindrical body portion 34 which contains an electric coil 35 (shown schematically in FIG. 4) and a solenoid plunger 36. The solenoid plunger 36 is mounted for axial movement within the body portion 34; it moves upwardly and downwardly within the vertical channel 30 of the bowl vent passage 29. A pair of leads 37 and 38 are connected to the coil 35, one lead 37 being joined to a power source 39 through an ignition switch 40 and the other lead 38 being joined to a ground. The electric coil 35 generates a magnetic field when a d-c voltage is applied to the lead 37; the magnetic field causes the solenoid plunger 36 to shift from a deenergized position to an energized position. The leads 37 and 38 are connected into the ignition circuit of the internal combustion engine so that the solenoid valve 33 is energized whenever the engine is running and the ignition switch 40 is closed.

When the engine is running, the solenoid plunger 36 is in its upper position opening the vertical channel 30; an enlarged section 41 is formed in the vertical channel 30 and it provides a valve seat. The lower end of the plunger 36 is contoured to fit within the vertical channel 30, and the plunger 36 has a constricted neck portion above its lower end which receives an O-ring 42. The O-ring 42 provides a tight air seal between the valve 33 and the valve seat, and also limits the upward movement of the solenoid plunger 36 when the solenoid valve 33 is energized.

The solenoid body portion 34 is mounted to the top of the carburetor housing 2. A generally Z-shaped clip 43 secures the body portion 34 to the upper end of the fuel adjustment needle 25, one leg 44 of the clip 43 clamps the body portion 34 to the housing 2 above the vertical channel 30 and the other leg 45 is hooked to the needle 25. A spring 46 is intermediate the headed end of the fuel adjustment needle 25 and the leg 44 of the clip 43, and it puts a predetermined load on the clip 43 to retain the body portion 34 in its desired position.

Figure 4:
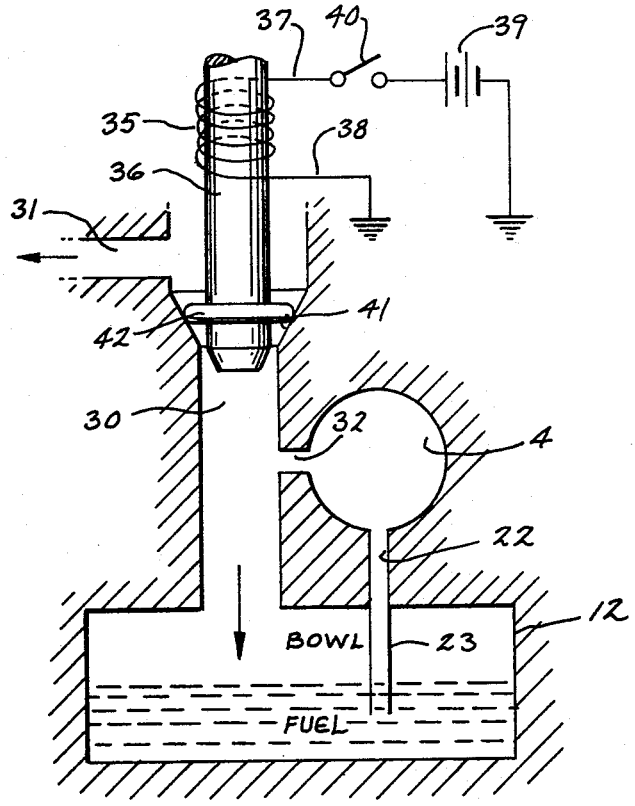
FIG. 4 is a diagrammatic view of the carburetor of FIG. 1 illustrating the basic principle involved in controlling dieseling.

FIG. 4 schematically portrays the operation of the shutdown control of the present invention. With the ignition turned on, the ignition switch 40 is closed, and the solenoid valve 33 is energized so that the plunger 36 is in its raised position. The bowl vent passage 29 is open, and the cavity in the fuel bowl 12 above the fuel is at atmospheric pressure. There is a lower pressure at the nozzle 22 than in the fuel bowl 12, and the pressure difference between the nozzle 22 and the fuel bowl 12 causes fuel to be delivered to the venturi constriction 4. When the ignition is turned off, the ignition switch 40 is open; the solenoid valve 33 becomes deenergized, and the plunger 36 moves to its lowered position with the O-ring 42 against the walls of the vertical channel 30 of the bowl vent passage 29. With the valve 33 closed, the pressures at the nozzle 22 and in the fuel bowl 12 will equalize, because of the duct 32 intercommunicating the fuel bowl 12 and the venturi constriction 4. As a result, the flow of fuel through the nozzle 22 will cease and the engine will not be able to "run on" or "diesel."

The engine is shut down by equalizing the pressures at the nozzle 22 and in the fuel bowl 12; thus, the duct 32 should be in the same plane as the nozzle 22. The duct 32 and the nozzle 22 are shown in the preferred embodiment as being within the venturi constriction 4; however, they could be located downstream from the venturi constriction 4. By placing them in the venturi constriction 4, there will be a maximum pressure difference acting on the fuel in the fuel bowl 12 causing it to flow into the air induction passage 3.

In the preferred embodiment, the duct 32 has a diameter of about 0.046 inches and an area of about 0.002 square inches, while the vertical channel 30 of the bowl vent passage 29 has a diameter of about 0.20 inches and an area of about 0.03 square inches. If the duct 32 is too small, then it will take too long for the pressures at the nozzle 20 and in the bowl 10 to equalize and engine "run on" will occur. However, if the duct 32 if too large, normal operation of the carburetor 1 will be hampered, for the pressure difference acting on the fuel in the bowl 12 will be reduced. Generally, the area of the vertical channel 30 of the bowl vent passage 29 should be at least about ten times greater than the area of the duct 32 to insure efficient carburetor operation without dieseling upon ignition turn off.

Dieseling is prevented because the pressures at the nozzle 22 and in the bowl 12 become equalized when the ignition is turned off. The duct 32 communicates the nozzle 22 with the cavity above the fuel in the bowl 12. Although the duct 32 leads into the vertical channel 30 of the bowl vent passage 29, this is not necessary. The present invention also contemplates connecting the duct 32 directly with the fuel bowl 12.

In order to prevent dieseling when the ignition is turned off when the engine is idling, an opening 47 (seen only in FIG. 2) is provided which leads from the air induction passage 3 downstream of the throttle plate 9 to the fuel bowl 12 and the cavity above the fuel. During idle, the throttle plate 9 is closed and the choke plate 7 is open; as a result, the air flow through the venturi passage 4 is not sufficient to draw fuel from the bowl 12 through the nozzle 22. However, a vacuum is created downstream of the throttle plate 9 by the engine intake manifold which draws fuel through an idle feed system (not shown). When the ignition is turned off with the carburetor 1 in idle position, the opening 47 allows the pressures in the fuel bowl 12 and air induction passage 3 to equalize, thus preventing the delivery of fuel downstream of the throttle plate 9 via the idle feed system and prohibiting dieseling.

The preferred embodiment of the invention shown and described herein provides an anti-dieseling device that is highly satisfactory and offers all of the noted advantages, and others, but it will be apparent that various modifications might be made without departure from the spirit of the invention. As previously indicated, the duct 32 could communicate at one end with the venturi constriction 4 and at its other end with the fuel bowl 12 rather than the vertical channel 30 of the bowl vent passage 29. Although it is preferable to connect the duct 32 to the bowl vent passage 29 at a height sufficiently above the bowl 12 to prevent fuel entering the duct 32 as a result of splashing. The shutdown control can be designed for any size engine including without limitation tractor, golf cart, and industrial engines. Also, the shutdown control can be used with carburetors other than the float type as illustrated in the preferred embodiment. Furthermore, valves other than solenoid valves can be used in the bowl vent passage 29; for example, an electromagnet which raises and lowers a steel ball could be satisfactorily employed. In view of these and other possible modifications, the invention is not intended to be limited by the showing or description herein, or in any other manner, except insofar as may be specifically required.

We claim:

1. In a carburetor for an engine having an ignition which carburetor includes an air passage adapted for connection to an engine intake manifold, a venturi constriction in said air passage, a float bowl and a discharge nozzle leading from the float bowl and adapted to deliver fuel into the venturi constriction, the improvement which comprises means for preventing dieseling which can occur when fuel continues to flow from the discharge nozzle when the ignition is turned off, which means includes a bowl vent passage communicating between the float bowl and a position at atmospheric pressure, valve means for opening and closing the bowl vent passage, said valve means being open when the ignition is on so that the float bowl is exposed to atmospheric pressure which causes fuel to flow from the float bowl through the nozzle of the venturi and closed when the ignition is off so the float bowl is not exposed to atmospheric pressure and pressure equalizing means which connects the venturi constriction to the float bowl, said pressure equalizing means including a duct which is small enough in diameter so as to not interfere with the normal functioning of the bowl vent passage when the valve means is open but large enough to equalize the pressure between the venturi constriction and the float bowl when the valve means is closed so that fuel will not flow through the nozzle to the venturi constriction to support dieseling.

2. The carburetor of claim 1 in which the valve means is a solenoid valve which is open when the ignition is on and is closed when the ignition is off.

3. The carburetor of claim 1 in which the bowl vent passage has an effective area which is at least 10 times greater than that of the duct.

4. The carburetor of claim 1 in which the duct communicates with the bowl vent passage at a point between the valve means and the float bowl.

* * * * *